US005090373A

United States Patent [19]

Kashiwara et al.

[11] Patent Number: 5,090,373

[45] Date of Patent: Feb. 25, 1992

[54] AUXILIARY DEVICE ATTACHABLE TO A CONVENTION SPARK PLUG

[76] Inventors: Ryohei Kashiwara, Raitsu Ootori 106, 456-1, Ootorikitamachi 8-cho, Sakai-shi, Osaka-fu; Hideaki Kashiwara, 3-B-611, 151-30, Mukojima Ninomarucho, Fushimi-ku, Kyoto-shi; Hidehiko Noguchi, 7-14, Taiho 3-chome, Kanancho, Minamikawachi-gun, Osaka-fu; Takeaki Kashiwara, 3-37-411, Nagayoshidedo 3-chome, Hirano-ku, Osaki-shi, all of Japan

[21] Appl. No.: 707,090

[22] Filed: May 29, 1991

[30] Foreign Application Priority Data

Nov. 30, 1990 [JP] Japan ..... 2-339489

[51] Int. Cl.[5] ..... F02P 1/00

[52] U.S. Cl. ..... 123/169 PA; 123/169 EL; 123/169 MG; 123/169 EB

[58] Field of Search ..... 123/169 PA, 169 CL, 123/169 EB, 169 R, 169 G, 169 MG; 313/125, 141, 140, 130, 139, 142, 143

[56] References Cited

U.S. PATENT DOCUMENTS

| | | | |
|---|---|---|---|
| 1,224,296 | 5/1917 | Gibson | 123/169 El |
| 1,243,205 | 10/1917 | Norman | 123/169 MG |
| 1,298,368 | 3/1919 | Metzinger . | |
| 1,360,294 | 11/1920 | Hill | 123/169 EL |
| 1,371,488 | 3/1921 | Jacobson | 313/139 |
| 1,644,633 | 10/1927 | Buckingham | 123/169 MG |
| 1,659,037 | 2/1928 | MacDonald | 123/169 EL |
| 1,943,674 | 1/1934 | Woods-Humphrey | 123/169 |
| 1,963,801 | 6/1934 | O'Marra | 123/169 El |
| 2,071,572 | 2/1937 | Rabezzana et al. | 123/169 EL |
| 2,096,199 | 10/1937 | Rabezzana | 123/169 EL |
| 2,129,003 | 9/1938 | Grant | 313/125 |
| 2,208,030 | 7/1940 | Holmes | 123/169 EL |
| 2,208,667 | 7/1940 | Devine | 313/141 |
| 2,217,825 | 10/1940 | Twining et al. | 123/169 EL |
| 2,246,948 | 6/1941 | McCarty et al. | 123/169 EL |
| 2,305,208 | 12/1942 | Trammel, Sr. et al. | 123/169 EL |
| 2,336,569 | 12/1943 | Rabezzana | 123/169 EL |
| 2,368,889 | 2/1945 | Setterblade | 123/169 El |
| 2,372,867 | 4/1945 | Tognola | 313/138 |
| 2,391,459 | 12/1945 | Hensel | 313/139 |
| 2,457,916 | 1/1949 | Newton | 123/169 PA |
| 2,616,407 | 11/1952 | Thomas | 313/125 |
| 2,944,178 | 7/1960 | Schaub | 313/141 |

List continued on next page.

FOREIGN PATENT DOCUMENTS

| | | | |
|---|---|---|---|
| 187501 | 10/1922 | United Kingdom | 123/169 EL |
| 0167687 | 1/1986 | European Pat. Off. | 123/169 EL |
| 2479588 | 10/1981 | France | 123/169 EL |
| 53-87331 | 11/1975 | Japan | 123/169 El |
| 52-1243 | 7/1977 | Japan | 123/169 EL |
| 53-25743 | 3/1978 | Japan . | |
| 53-25743 | 3/1978 | Japan | 123/169 EL |
| 53-121107 | 9/1978 | Japan | 123/169 EL |
| 53-54774 | 10/1978 | Japan | 123/169 EL |
| 53-123826 | 10/1978 | Japan | 123/169 EL |
| 54-91644 | 7/1979 | Japan . | |
| 54-117948 | 9/1979 | Japan | 123/169 EL |
| 54-146001 | 11/1979 | Japan | 123/169 El |
| 55-13755 | 1/1980 | Japan | 123/169 EL |
| 55-46481 | 4/1980 | Japan | 123/169 EL |
| 60-212989 | 10/1985 | Japan | 123/169 EL |
| 61-112726 | 5/1986 | Japan | 123/169 EL |
| 61-30394 | 7/1986 | Japan | 123/169 EL |
| 62-11471 | 3/1987 | Japan | 123/169 EL |
| 1-176690 | 7/1989 | Japan | 123/169 EL |
| 1-289085 | 11/1989 | Japan | 123/169 EL |
| 2142080 | 5/1990 | Japan . | |
| 2144873 | 6/1990 | Japan . | |

*Primary Examiner*—Raymond A. Nelli

*Attorney, Agent, or Firm*—Fisher, Christen & Sabol

[57] ABSTRACT

Two fundamental types of auxiliary devices for increasing the fuel efficiency of a conventional spark plug without reforming any part of the spark plug. Each type has a pair of opposing tongues having parallel grooves on their opposing inside faces and flat portions bridging the tongues with which the device is attached to either the top of metal housing and/or ground electrode or the top of center electrode by welding or caulking.

14 Claims, 14 Drawing Sheets

U.S. PATENT DOCUMENTS

| | | | |
|---|---|---|---|
| 3,229,139 | 1/1966 | Watson . | |
| 3,238,447 | 1/1966 | Bychinsky | 123/169 EL |
| 3,313,972 | 4/1967 | Beesch | 313/130 |
| 3,515,925 | 6/1970 | Rickhey | 313/139 |
| 3,710,772 | 1/1973 | Warner | 123/169 R |
| 3,908,625 | 9/1975 | Romy . | |
| 3,921,020 | 11/1975 | Wax | 313/123 |
| 3,970,885 | 7/1976 | Kasima | 313/141 |
| 4,023,058 | 5/1977 | Lara et al. | 313/139 |
| 4,028,576 | 6/1977 | Wofsey | 313/143 |
| 4,029,075 | 6/1977 | Noquchi et al. | 123/169 PA |
| 4,109,633 | 8/1978 | Mitsudo et al. | 123/169 EL |
| 4,123,998 | 11/1978 | Heintzelman | 313/143 |
| 4,164,912 | 8/1979 | Beyler | 123/26 |
| 4,242,990 | 1/1981 | Schoronborg et al. | 123/169 PA |
| 4,336,477 | 6/1982 | Yamada | 123/169 El |
| 4,401,915 | 8/1983 | Kashiwara et al. | 313/142 |
| 4,516,548 | 5/1985 | May | 123/169 PA |
| 4,808,878 | 2/1989 | Kashiwara et al. | 313/141 |
| 4,851,732 | 7/1989 | Kashiwara et al. | 123/169 EL |
| 4,901,688 | 2/1990 | Kashiwara et al. | 123/169 EL |
| 4,983,877 | 1/1991 | Kashiwara et al. | 123/169 EL |
| 5,007,389 | 4/1991 | Kashiwara et al. | 123/169 MG |

AUXILIARY DEVICE ATTACHABLE TO A CONVENTION SPARK PLUG

FIELD OF THE INVENTION

The invention relates to a spark plug used for internal combustion engines of automobiles and the like. More particularly, it relates to an auxiliary device attachable to a conventional spark plug for internal combustion engines by which the performance of the spark plug is greatly improved in terms of the fuel efficiency.

PRIOR ART

According to the prior art, a spark plug is generally and conventionally constructed from center electrode and ground electrode, in which the center electrode is put in the center of electric insulating ceramic, the ground electrode is attached to metal housing covering the insulating ceramic and the free end of the ground electrode is inwardly bent into L-shape toward the axial line of the center electrode in such a way that spark gap is formed between the top surface of the center electrode and the bent portion of the ground electrode opposing parallel to each other.

On account of such structure, in most cases the ground electrode had to be reformed or replaced with any alternative means in order to improve the performance of the spark plug. Therefore, there used to be lots of difficulties in the reforming process.

However, according to the invention, a conventional spark plug available on the market can be reformed and its performance can be improved surprisingly without accompanying any difficulty by simply attaching or welding an auxiliary device to the ground electrode and/or the top portion of metal housing or to the center electrode.

OBJECT OF THE INVENTION

Accordingly, it is the object of the invention to provide a simple structured auxiliary device by which the performance of a conventional spark plug is widely increased and the reforming thereof is very simply conducted. The above and other objects and features of the invention will appear more fully hereinafter from a consideration of the following description taken in connection with the accompanying drawing wherein examples are illustrated by way of example.

BROAD DESCRIPTION OF THE INVENTION

The invention involves two fundamental types of auxiliary devices for increasing the fuel efficiency of a conventional spark plug without reforming any part of the spark plug. Each type has a pair of opposing tongues having parallel grooves on their opposing inside faces and flat portions bridging the tongues with which the device is attached to either the top of metal housing and/or ground electrode or the top of center electrode by welding or caulking.

PREFERRED EMBODIMENT OF THE INVENTION

Figure 1:
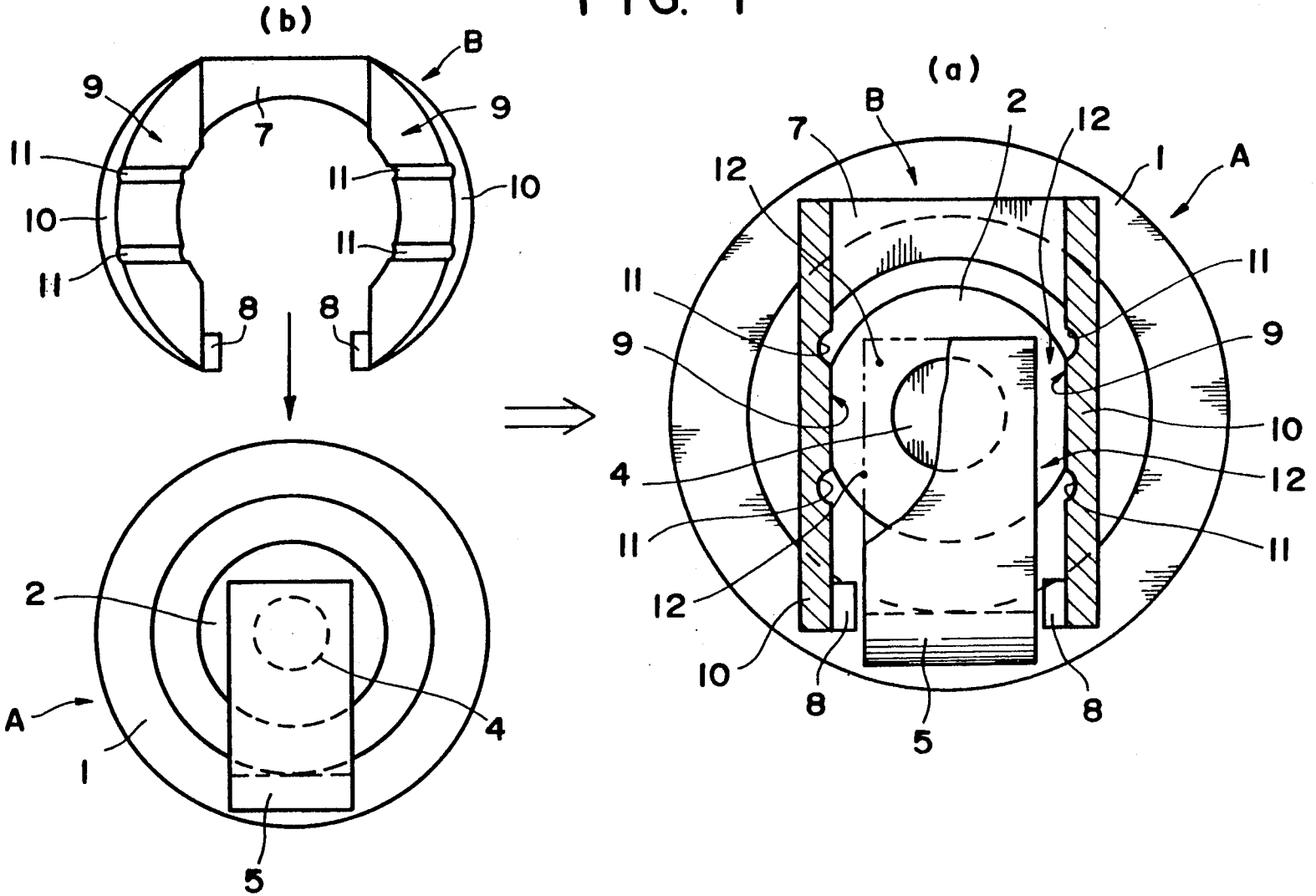
FIGS. 1, 2, 3, 4 and 5 are a bottom view, a side view and an elevational view of a conventional spark plug and a type of auxiliary device of the invention welded to ground electrode and/or the lower end of metal housing of the spark plug.
Figure 2:
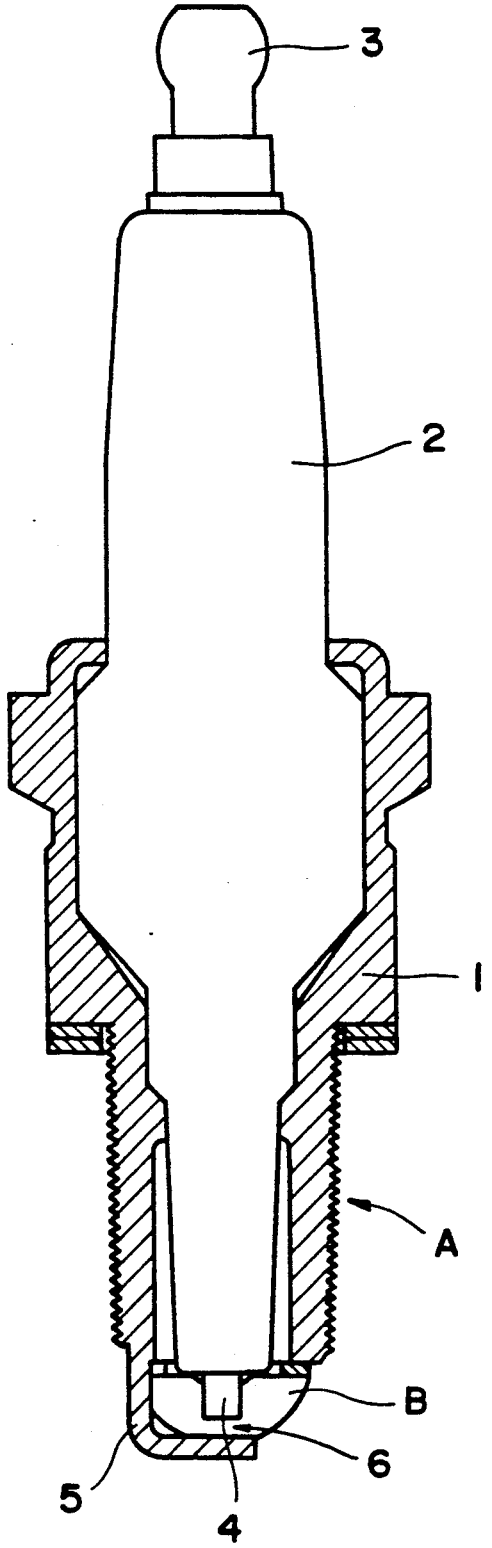

The invention will be described below in detail with reference to the accompanying drawing. As shown in FIGS. 1 through 5, a conventional spark plug A generally comprises center electrode 4 and ground electrode 5, which are opposed to each other with spark gap 6 put in between. More specifically, a porcelain electric insulator 2 holds the center electrode 4 with terminal 3 in the core portion thereof and grounded metal housing 1 holds the porcelain electric insulator 2. The ground electrode 5, which is bent into an L-shape toward the center electrode 4, is united to the metal housing 1 in one, wherein its first bent arm (bent portion) is parallel to and confronts the top surface of the center electrode 4 so as to define spark gap there, and its second straight arm (straight portion) is parallel to the axial line of the center electrode 4. (A conventional spark plug of this type is hereinafter simply referred to as a conventional spark plug or a spark plug.)

Figure 6:
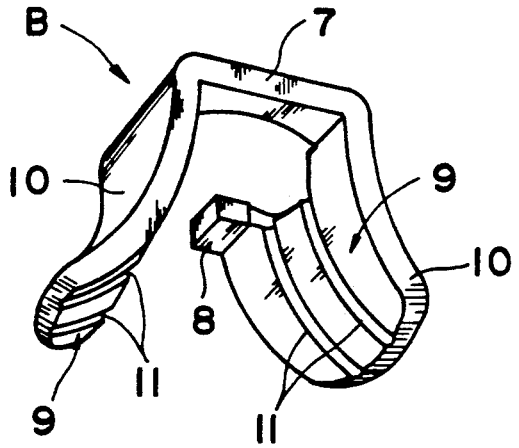
FIG. 6 is a perspective view of the detached auxiliary device, already shown in FIGS. 1 to 5.

In this invention, however, provided to the top portion of the spark plug A is an auxiliary device B for improving the ignition or initial combustion of fuel mixture. The auxiliary device B, which is made of heat resistant steel, comprises a pair of tongues 10, 10 which have a plurality of parallel grooves on their opposing inside surfaces 9, 9, and flat portions 7, 8, 8 which are supported by the tongues in between, as shown in FIG. 6. The inventors have found it very effective in improving the ignition of fuel mixture in the spark plug from their practical test and consider that its outwardly widening inside surfaces 9, 9, on which grooves 11, 11 are provided parallel to the axial line of the center electrode 4, contribute to spreading ignited fuel mixture along the grooves and accelerating combustion in the spark plug.

As shown in FIG. 1, space 12 from where remarkable ignition begins is formed between the center electrode 4 and each of the four grooves 11 respectively, and there the center electrode and the opposing inside surfaces 9, 9 of the tongues 10, 10 are most close to each other. According to the inventors, the first ignition happens in the spark gap 6 by sparks, the second ignition is caused by the first close thereto and the third remarkable ignition or combustion begins to spread, traveling along the grooves 11 on the inside surfaces 9, 9 of the tongues 10, 10, when the second ignition reaches the grooves. Expanding combustion gas strikes on the flat portions 7, 8, 8 and the opposing inside surfaces 9, 9 of the tongues 10, 10 so as to form there turbulent flows heading for the piston side which help yet un-ignited fuel mixture more readily ignite.

As best seen from the above, according to the invention, a conventional spark plug A is provided with the auxiliary device B, by which the ignition of fuel mixture is accelerated a great deal with the aid of the opposing inside surfaces 9, 9 of its tongues 10, 10 and the grooves thereon.

Figure 4:
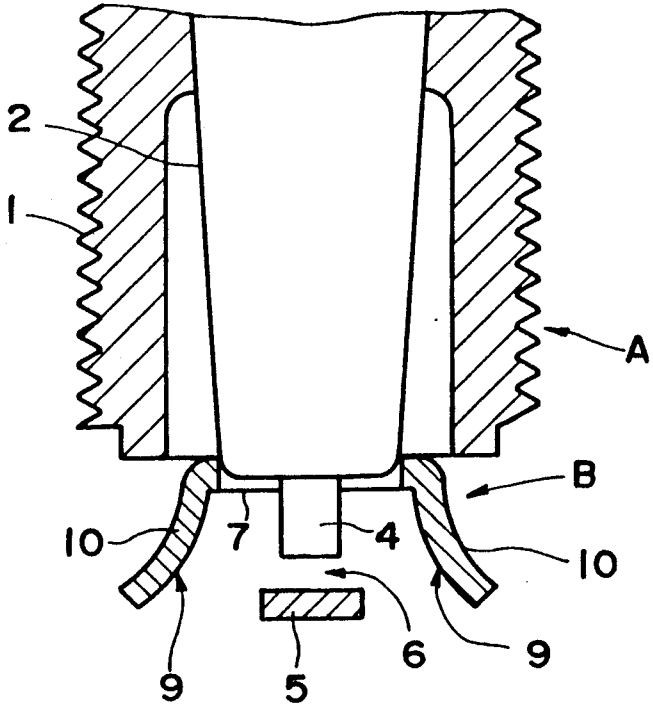
Figure 3:
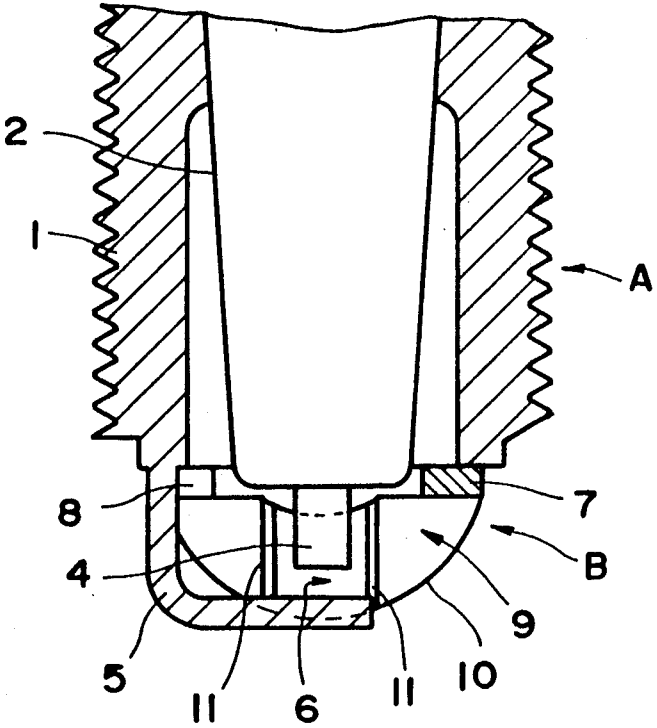
Figure 5:
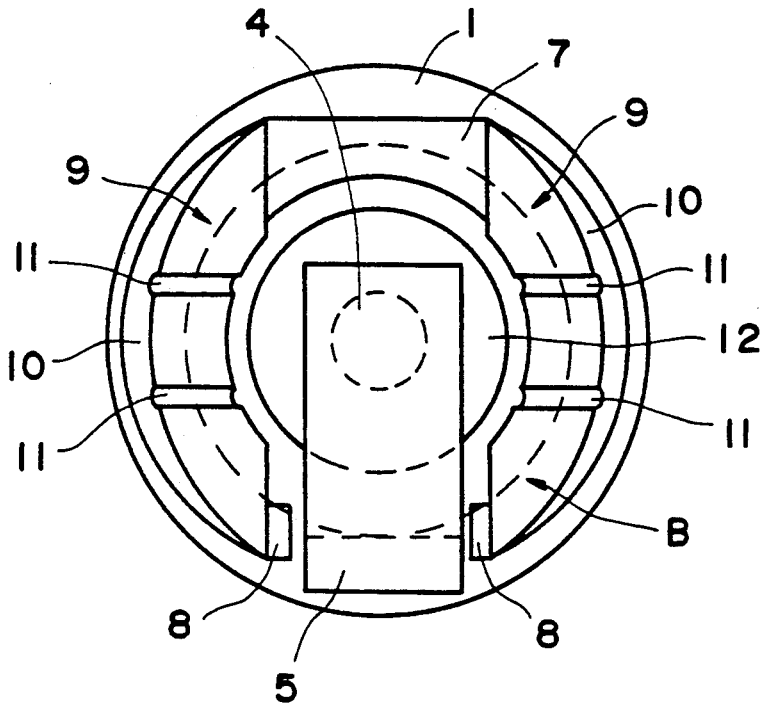

In this example, heat-resistant steel is machined into a shape as shown in FIG. 6 and then attached to the top of the metal housing 1 of a conventional spark plug A by welding as shown in FIGS. 3 to 5. When the auxiliary device B is attached to a conventional spark plug, any part of the latter A does not need reforming at all. Practically, the center electrode 4 and the straight portion of the ground electrode 5, both of which are parallel to the axial line of the spark plug, are put together in the divided flat portions 8, 8 of the auxiliary device B with the center electrode 4 ahead as far deep as the porcelain electric insulator 2 of the center electrode 4 comes into contact with the continuous flat portions 7 of the auxiliary device bridging the tongues and then the metal housing 1 and the auxiliary device B are united to each other in one by welding. After welding, the center electrode 4 is completely detached from any part of the auxiliary device B by the porcelain electric insulator 2 and its electric isolation is thus assured, which can clearly be seen from FIG. 1*a* or FIG. 5.

The spark plug equipped with the auxiliary device B according to the invention can reduce the induction period before complete combustion, prevent the formation of incomplete combustion gas, alleviate the output loss in the compression cycle of the piston, and economize the fuel consumption, increasing the engine efficiency.

The following table shows the result of a test that was performed in order to see how much difference there is in terms of the fuel efficiency of a conventional spark plug, when equipped with or without the auxiliary device B of the invention. The condition of the test was made as same as possible. For this purpose, an ordinary passenger, 4 cycle 1300 cc cylindered car was driven at a speed of 40–50 Km/H. (sometimes maximum speed had to be kept at 60 Km/H for some while for the traffic reason) on the same course in Osaka city with no load, provided the ignition timing and the amount of fuel to feed were previously adjusted to the same level.

TABLE

| Spark plug | Consumed fuel | Covered mileage | Fuel efficiency | Ratio of efficiency |
|---|---|---|---|---|
| With Aux. Device | 7.12 L | 116 km | 16.29 km/L | 128% |
| Without Aux. Device | 8.82 L | 112 km | 12.70 km/L | 100% |

Figure 8:
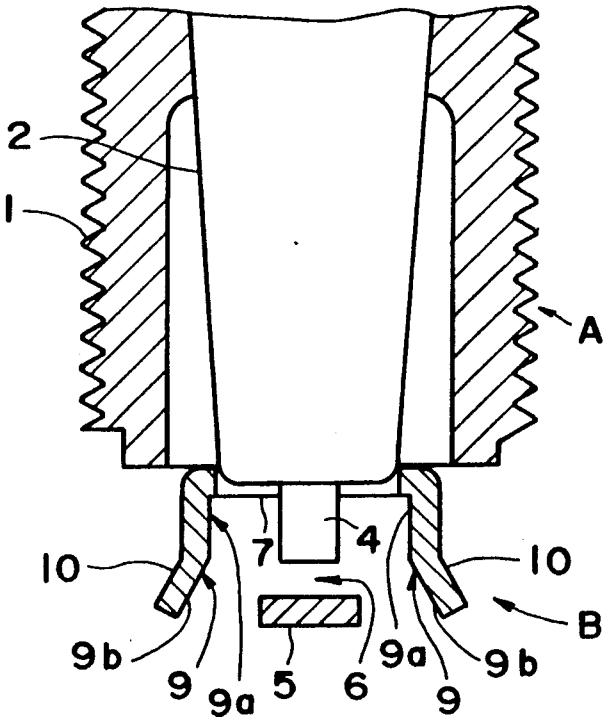
FIGS. 7 to 14 are illustrations for showing variations of tongues in the auxiliary device of the invention.
Figure 7:
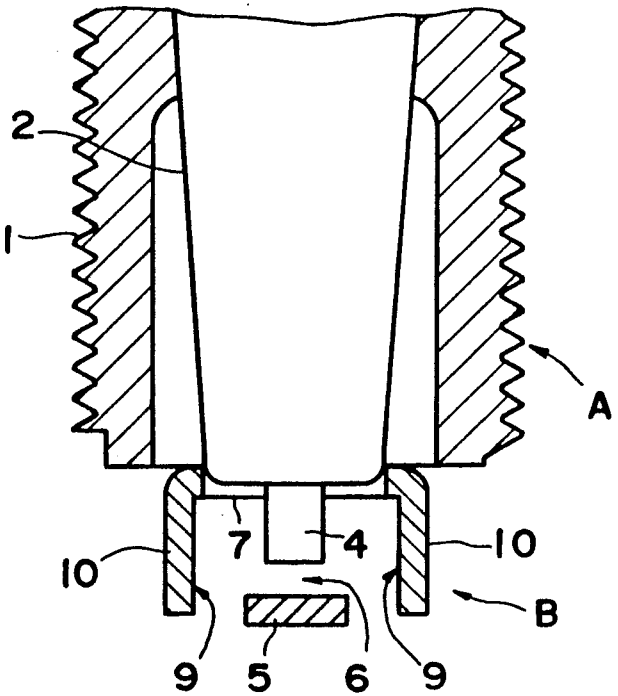
Figure 9:
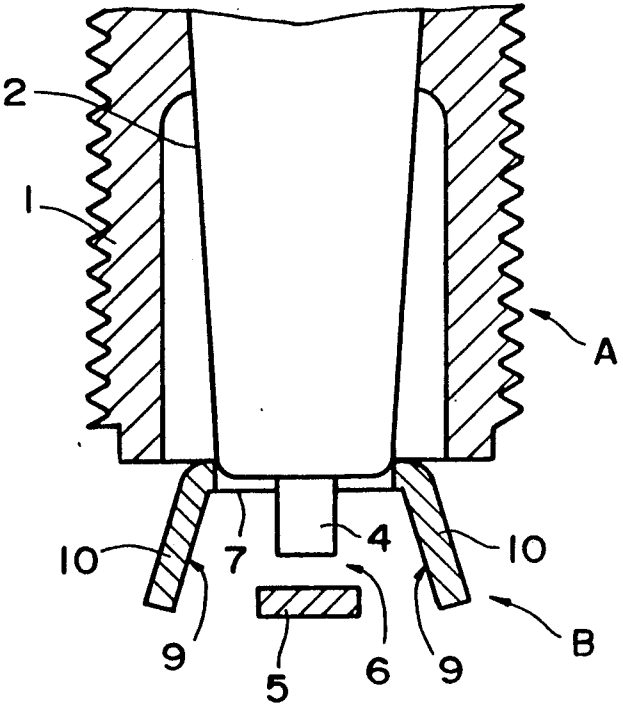

FIGS. 7 to 9 show a variation of the auxiliary device B shown in FIGS. 1 to 6. As shown in FIG. 4, the tongues 10, 10 of the auxiliary device are outwardly and symmetrically bent in a gentle curve; however, they may be parallel to each other, as shown in FIG. 7. Also, they may be parallel to each other as far as near the middle of their length and then outwardly bent in a gentle curve in FIG. 8; and they may be straight and open toward the piston in FIG. 9.

Figure 10:
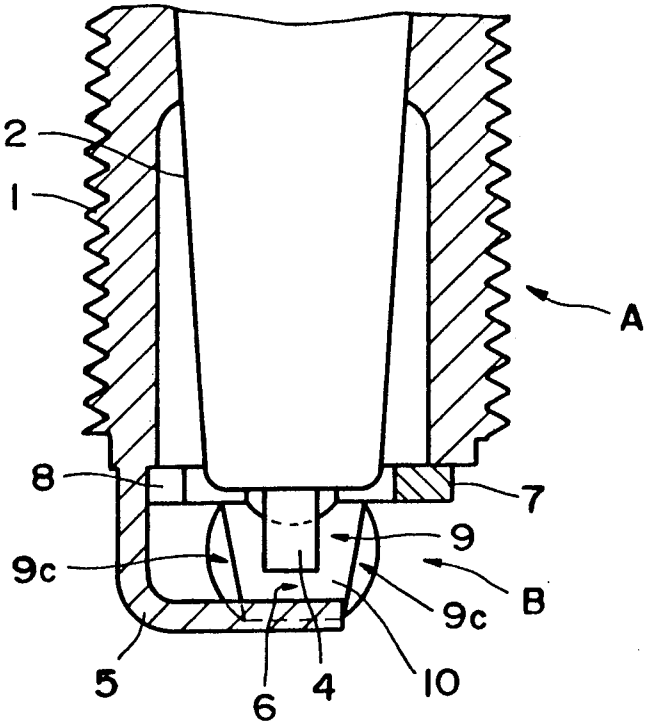
Figure 12:
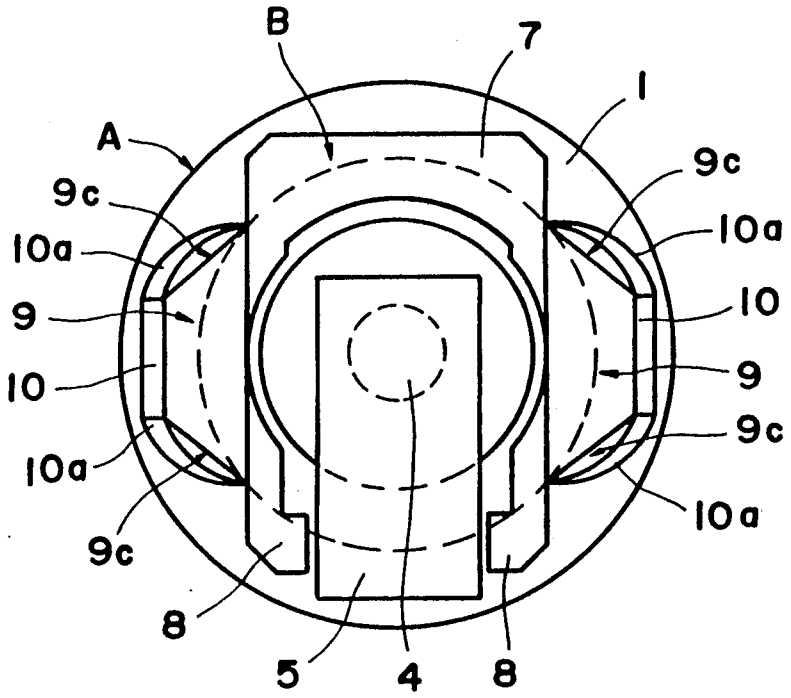
Figure 11:
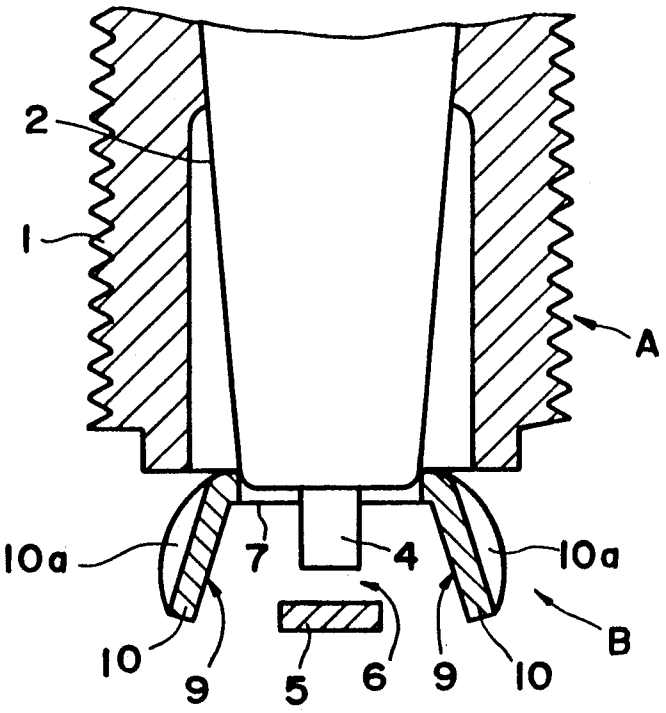

FIGS. 10 to 12 show another variation of the auxiliary device B in FIG. 9, in which both the arciform sides of the tongues 10, 10 are outwardly bent as shown by 10*a*, 10*a* in order that expanding combustion gas or ignited fuel mixture may spread along on their turned-over inside surface 9*c*, 9*c* in the spark plug.

Figure 13:
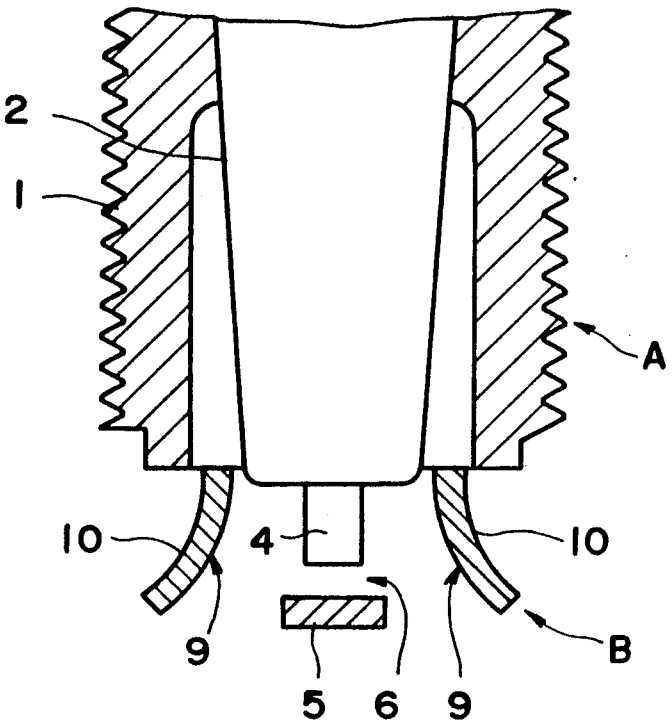
Figure 16:
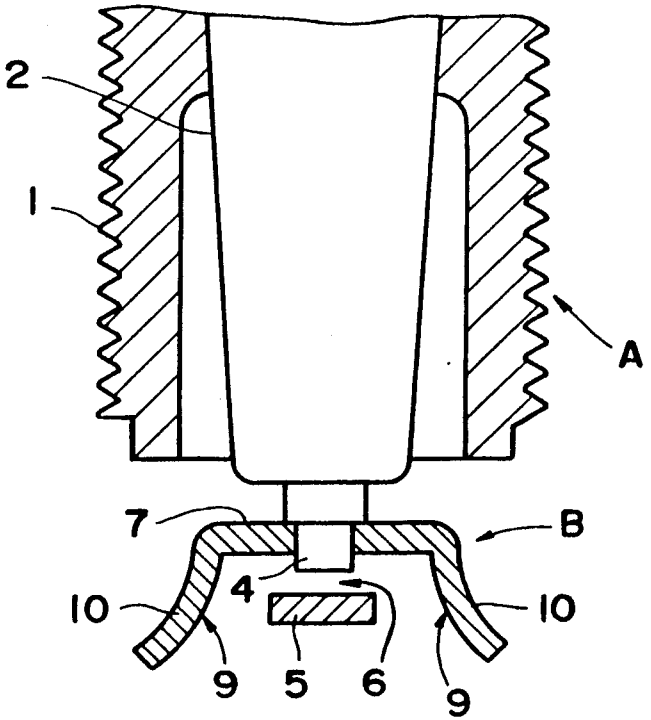
FIGS. 15 to 17 are a side view, an elevational view and a bottom view of another type of the auxiliary device of the invention welded to the center electrode of a conventional spark plug.
Figure 15:
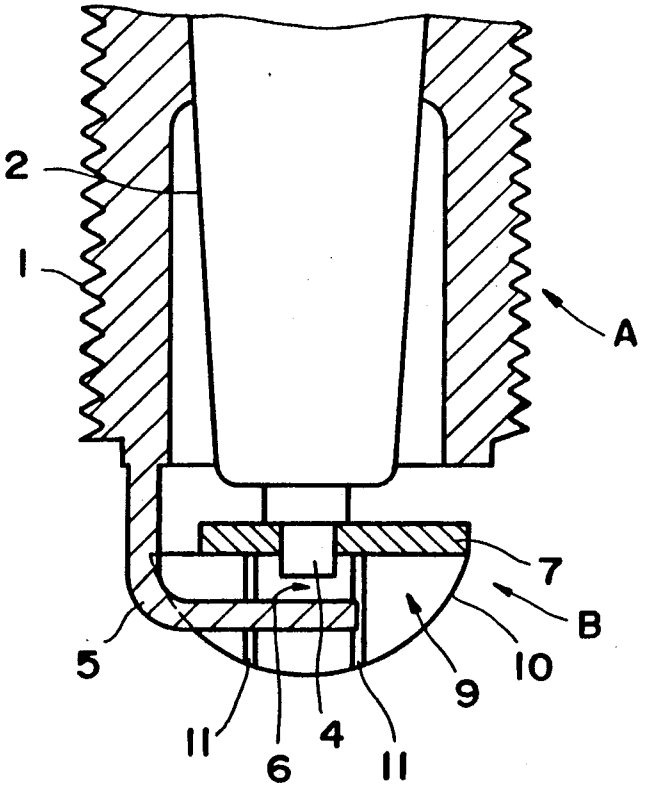
Figure 17:
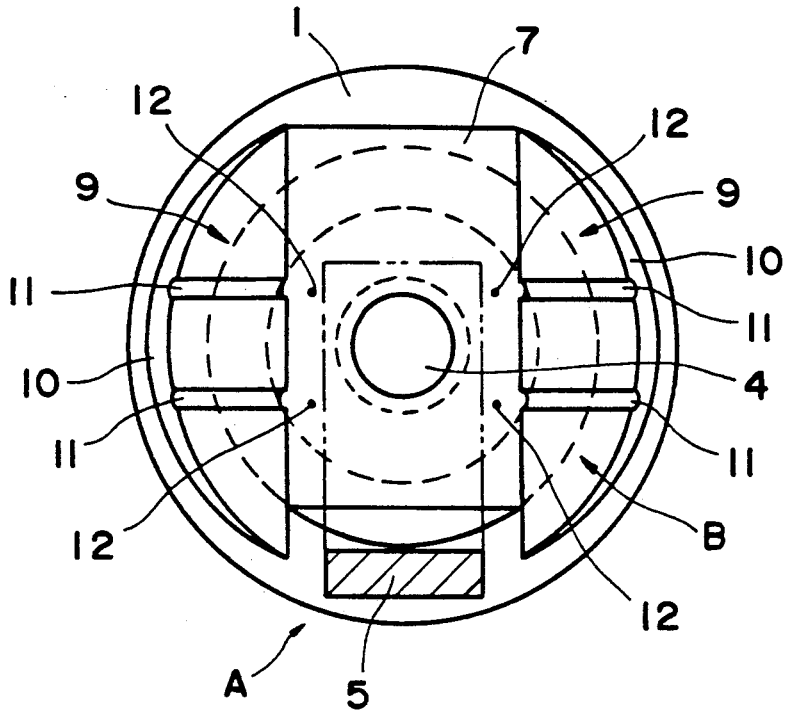
Figure 18:
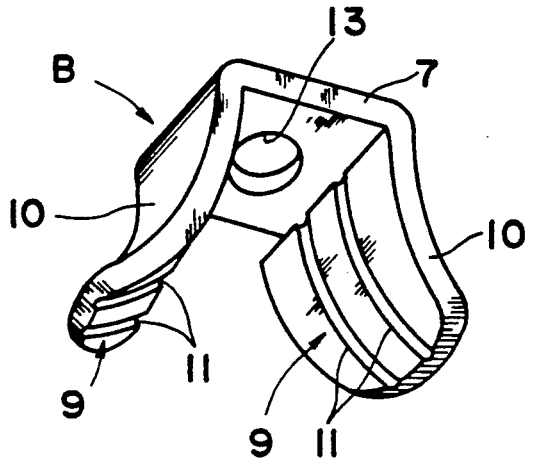
FIG. 18 is a perspective view of the detached auxiliary device, already shown in FIGS. 15 to 17.

FIG. 13 shows that only the tongues 10, 10 are directly attached to the top of the metal housing 1, by which the flat portions 7, 8 are eliminated.

Figure 14:
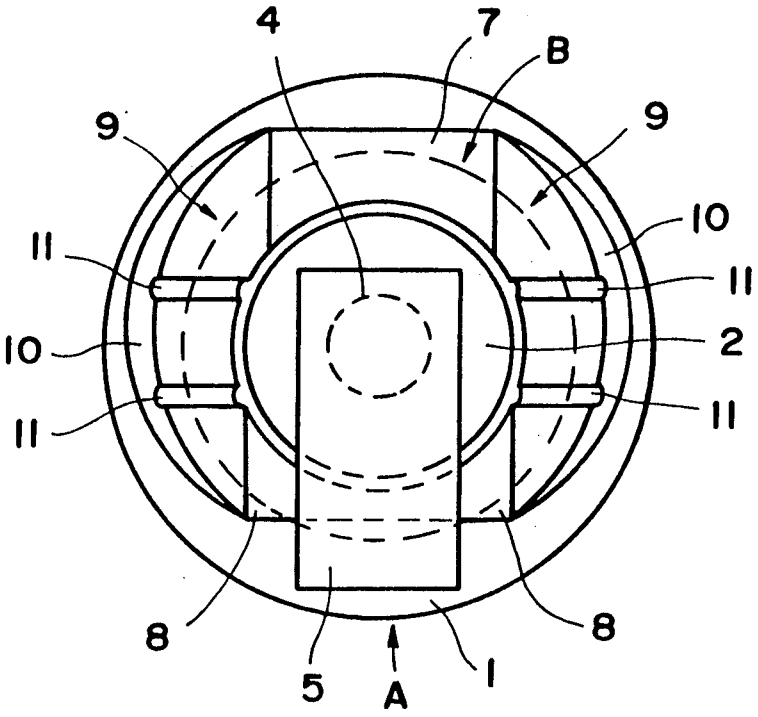

FIG. 14 shows a variation of the auxiliary device, in which the tongues 10, 10 and the flat portions 7, 8 are united at both sides of the tongues and the auxiliary device thus produced is welded to the top of the metal housing 1, wherein top of the flat portions is made larger than that shown in FIGS. 5 in order that expanding combustion gas may be struck back better thereon for igniting fuel mixture in the spark plug. For this purpose, the thickness of the flat portions 7, 8 is made a little greater than the spark gap 6.

FIGS. 15 to 18 show still another variation of the auxiliary device B of the invention. The variations of auxiliary device B so far described with reference to FIGS. 1 to 14 are of a type welded to the ground electrode or the top of the metal housing 1; however, this type of variation shown in FIGS. 15 to 18, whose shape is substantially the same as the one in FIG. 6 except for a single plate-type flat portion bridging the tongues, is welded to the center electrode 4 at its perforation 13 made through the center of the flat portion 7 as large as the top portion of the center electrode can pass through. In this example, the auxiliary device B is spaced apart to the metal housing 1 and to the ground electrode 5 farther than the center electrode 4 is spaced apart to the ground electrode 5 in order that sparks may always generate between the center electrode and the ground electrode. As stated in the first example shown in FIGS. 1 to 6, the original ignition in the spark gap caused by sparks develops into second ignition in the narrowest space 12, which ignites fuel mixture between the tongues 10, 10. The ignited fuel mixture between the tongues expands out of the tongues on combustion and then instantaneously ignites the entire fuel mixture in the spark plug. In the meantime, a kerf (not shown here), in place of the perforation 13, may be provided to one side of the flat portion 7 toward the center thereof so that the center electrode 4 can be put in the kerf.

Figure 19:
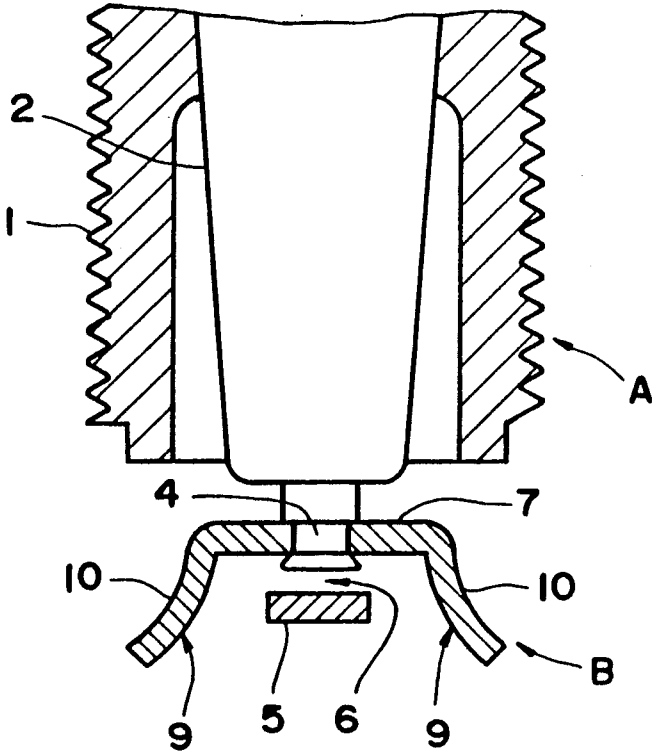
FIG. 19 is a side view of the same auxiliary device shown in FIGS. 15 to 17, attached to the center electrode of a spark plug by caulking the top of the center electrode.

FIG. 19 shows still another variation of the auxiliary device B of the invention. In this example, the top of the center electrode 4, whose diameter is previously made smaller than that of the foot, is put in the center hole 13 of the auxiliary device B and then caulked in order to firmly fix the auxiliary device thereto, whereby the welding of the auxiliary device and the center electrode can be eliminated. As a matter of course, the shape of the tongues 10, 10 in FIGS. 15 to 18 and 19 can be modified like those shown in FIGS. 7 to 12.

Figure 20:
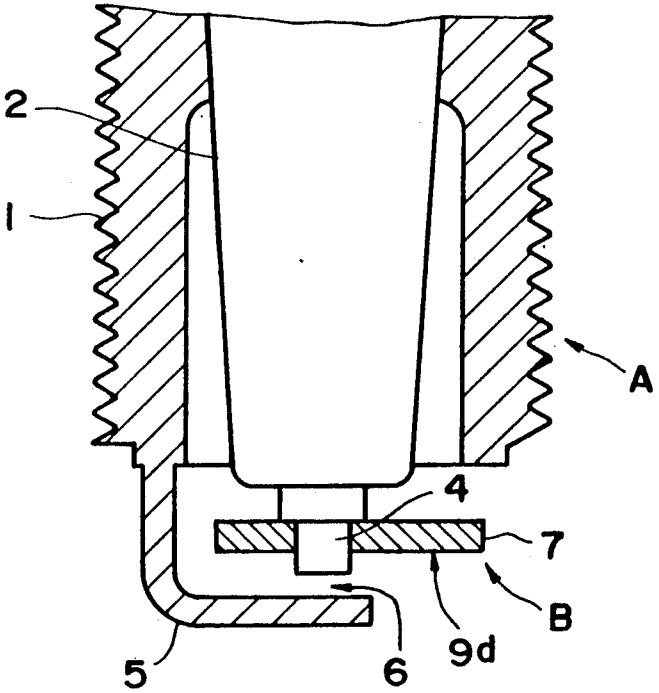
FIGS. 20 to 22 are a side view, a bottom view and a partially enlarged elevational view of the top portion of center electrode equipped with a plate type auxiliary device.
Figure 21:
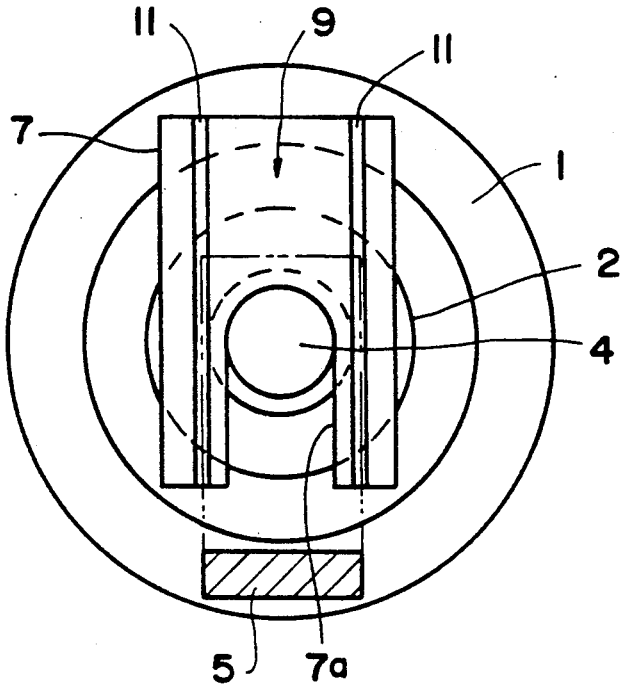
Figure 22:
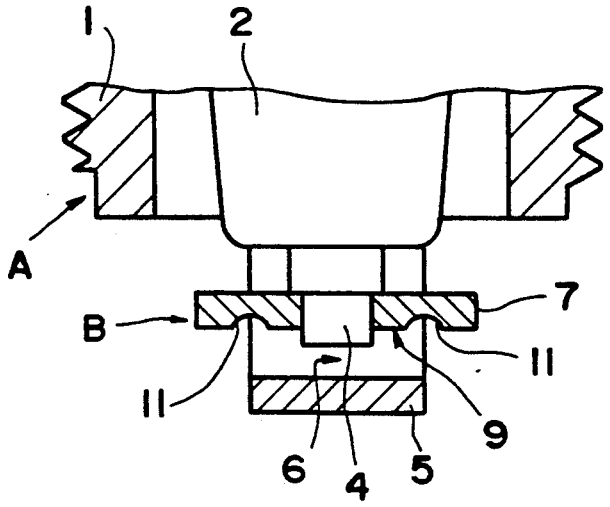

FIGS. 20 to 22 show still another variation of the auxiliary device B of the invention. The auxiliary device of this example has no tongue 10. Therefore, it is simply formed into a flat plate. A kerf to put the center electrode 4 in is made on either lateral side of the long plate 7 and a plurality of parallel grooves 11, 11 are made on one face 9 of the plate along the longitudinal direction thereof. The plate 7 and the center electrode 4 are welded to each other at the shoulder of the center electrode so that the grooved surface 9 of the plate confronts the ground electrode, the top of the center electrode may appear on that grooved surface 9 and the longitudinal direction of both the plate 7 and the ground electrode 5 may be substantially parallel to each other. Firstly ignited fuel nuclei generated in the spark gap 6 develop between the plate 7 and the ground electrode 5 opposing to each other make second ignition nuclei there on the surface 9 in such a manner as to ignite fuel mixture in the grooves 11. The second ignition nuclei having grown in the grooves 11 on the surface 9 spread over the inside of the spark plug and rapidly complete one cycle of combustion. In this respect, the object of providing the grooves on the inner surface 9 of the plate 7 is to place a smallest possible amount of fuel mixture near the spark gap by using the grooves. This comes from the fact that the less the amount of fuel, the more rapidly the fuel can be ignited because, as is always the case, the heat capacity of fuel becomes smaller in proportion to the lessening amount of the fuel and the fuel temperature can readily rise to the ignition temperature, even though the specific heat is equal over the fuel. The similar thing can be seen when a piece of match with square cross section is burning. Its edges always more readily take fire and sooner carbonize than the other parts thereof although the specific heat of wood forming the match is substantially the same all over.

Figure 23:
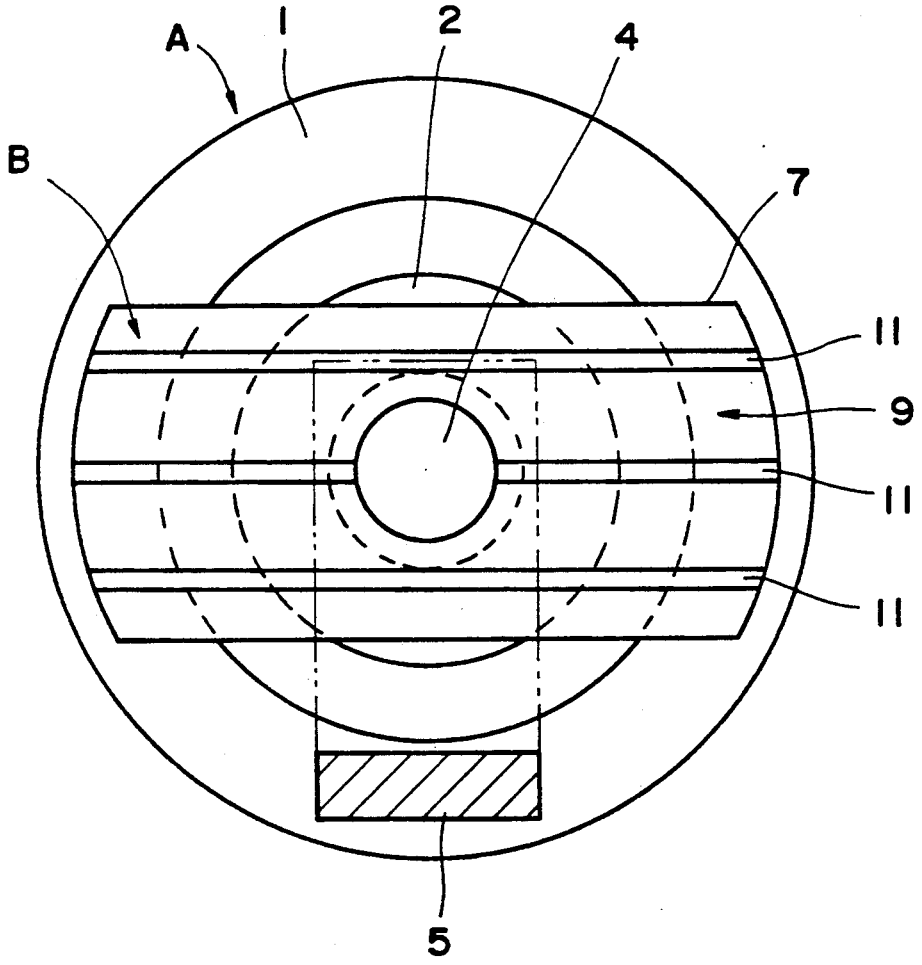
FIG. 23 is a bottom view of the top portion of center electrode to which a rectangular plate type auxiliary device is attached at right angles to ground electrode.

FIG. 23 shows another variation of the auxiliary device shown in FIGS. 21 and 22. That is, in the former example, the long plate 7 is placed parallel to the longitudinal direction of the ground electrode 5, while in this example, they are crossed substantially at right angle to each other, by which the grooved surface 9 of the plate 7 can effectively be used for the ignition in the early stage.

Figure 24:
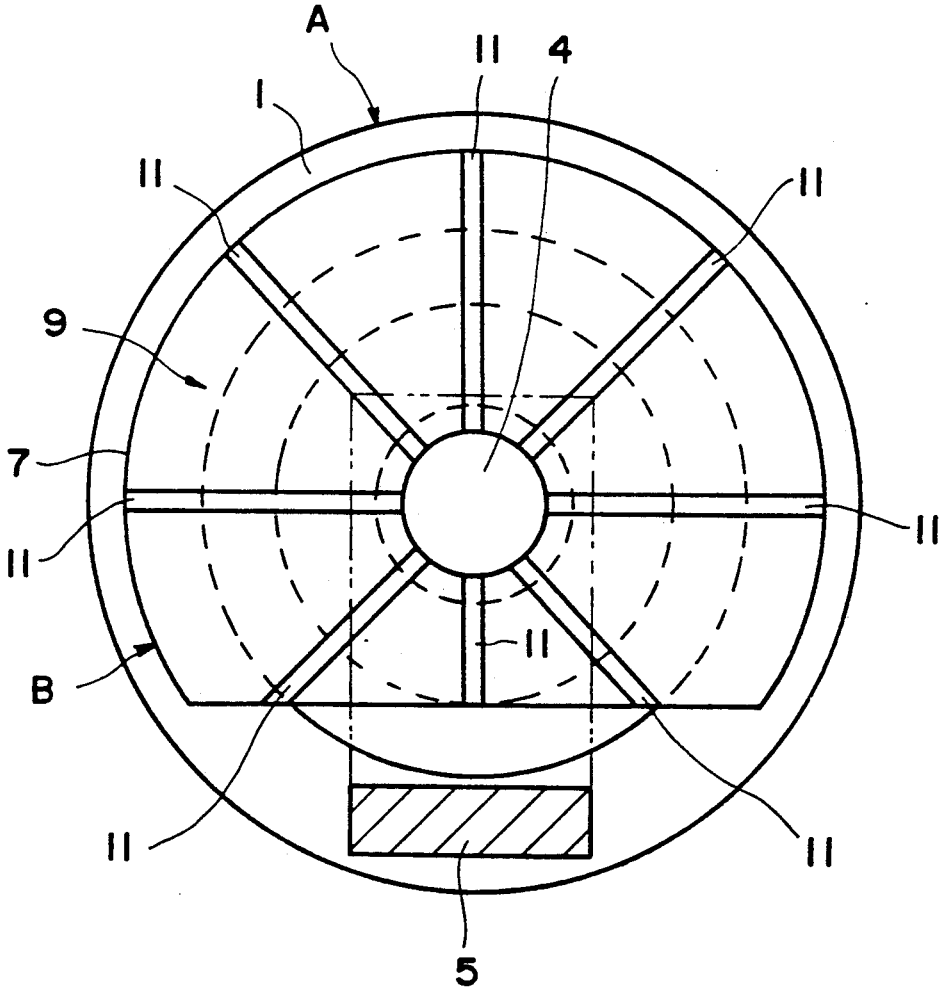
FIG. 24 is a bottom view of the top portion of center electrode to which a round plate type auxiliary device is attached.

FIG. 24 shows still another variation of the auxiliary device of the invention shown in FIGS. 21 to 23. In this example, the plate 7 is formed into a considerably larger, round plate and plurality of concentric or radial grooves 11, 11 are provided thereon around the center perforation 13, by which ignition can take place very rapidly and expanding combustion gas is strongly directed to the piston after having struck the grooved surface 9 of the plate 7, which confronts the ground electrode 5.

As can be seen from the above, the auxiliary device B of the invention can be attached either to (1) the ground electrode 5 and/or the top of the metal housing 1 or (2) the top of the center electrode 4 of a conventional spark plug A available on the market by simple welding and thereby its performance or fuel efficiency can be improved a great deal.

What is claimed is:

1. An auxiliary device attachable to the top of the metal housing of a conventional spark plug, having a ground electrode and a center electrode, for improving the ignition and combustion of said spark plug comprising: a pair of opposing tongues that have a plurality of parallel grooves on their opposing inside faces and flat portions supported by said tongues in between, said flat portions comprising two parts, one part being continuous in order to connect said tongues to each other and the other part being divided in order to allow the straight portion of the ground electrode and the center electrode to be put therein, wherein said ground electrode and said continuous part of said flat portions are attached to each other by welding, after the straight portion of said ground electrode and said center electrode are put into said divided part of said flat portions with the center electrode ahead as far deep as the porcelain electric insulator of said center electrode and said continuous part of said flat parts come into contact with each other.

2. An auxiliary device as set forth in claim 1, in which said tongues are outwardly bent in a gentle curve respectively with said center electrode in between.

3. An auxiliary device as set forth in claim 1, in which said tongues are parallel to each other with said center electrode in between.

4. An auxiliary device as set forth in claim 1, in which said tongues are parallel to each other as far as near the middle of their length and then outwardly bent in a gentle curve thereafter.

5. An auxiliary device as set forth in claim 1, in which said tongues are straight and open toward the piston side.

6. An auxiliary device as set forth in claim 1, in which the tongues are straight and open toward the piston side and both sides thereof are outwardly bent so that their inside surface is turned over.

7. An auxiliary device as set forth in claim 1, in which said continuous part of said flat portions, bridging said tongues, are eliminated and only said tongues are attached to the top of said metal housing by welding.

8. An auxiliary device as set forth in claim 1, in which both of said flat portions are continuous to bridge said tongues and welded to the top of said metal housing.

9. An auxiliary device attachable to the top of center electrode of a conventional spark plug for improving the ignition and combustion of said spark plug comprising: a pair of opposing tongues that have a plurality of parallel grooves on their opposing inside faces and flat portions supported by said tongues in between, said flat portions being comprised essentially of a plate which is perforated in the center so that the top of center electrode of said spark plug is allowed to pass therethrough and project out of the flat portions and the attachment of said flat portions and said center electrode can be made by welding by way of said perforation.

10. An auxiliary device as set forth in claim 9, in which the attachment of said flat portions and said center electrode is made by caulking said top of said center electrode after said top of said center electrode is allowed to pass through said perforation.

11. An auxiliary device as set forth in claim 9, in which both of said tongues are eliminated and only said flat portions provided with a plurality of parallel grooves on one face thereof is attached to said top of said center electrode by welding so that said top of said center electrode is allowed to project out of said grooved face of said flat portions from said perforation and said grooved face of said flat portions confronts said ground electrode.

12. An auxiliary device as set forth in claim 11, in which the direction of said parallel grooves on said flat portions is substantially parallel to the longitudinal direction of said ground electrode.

13. An auxiliary device as set forth in claim 11, in which the direction of said parallel grooves on said flat portions is substantially at right angles to the longitudinal direction of the ground electrode.

14. An auxiliary device as set forth in claim 11, in which said flat portions is formed into a circular shape and a plurality of concentric or radial grooves ar provided around said perforation on one face of said flat portions confronting said ground electrode.

* * * * *